US005145422A

United States Patent [19]

Fry

[11] Patent Number: 5,145,422

[45] Date of Patent: Sep. 8, 1992

[54] FEMALE ELECTRICAL TERMINAL WITH IMPROVED CONTACT FORCE

[75] Inventor: Rupert J. Fry, Des Plaines, Ill.

[73] Assignee: Molex Incorporated, Lisle, Ill.

[21] Appl. No.: 814,130

[22] Filed: Dec. 30, 1991

[51] Int. Cl.[5] ..... H01R 13/00

[52] U.S. Cl. ..... 439/856; 439/924

[58] Field of Search ..... 439/845, 849, 850, 856, 439/857, 861, 862, 924

[56] References Cited

U.S. PATENT DOCUMENTS

| | | | |
|---|---|---|---|
| 3,192,498 | 5/1962 | Ruehlemann . | |
| 4,175,821 | 11/1979 | Hunter | 439/856 |
| 4,687,278 | 7/1986 | Grabbe et al. . | |
| 4,717,361 | 1/1988 | Igarashi et al. | 439/856 |

*Primary Examiner*—Joseph H. McGlynn

*Attorney, Agent, or Firm*—Stephen Z. Weiss

[57] ABSTRACT

A female electrical terminal is disclosed for mating with a male electrical terminal. The female terminal includes a forward mating end for receiving the male terminal along a front-to-rear axis and a rear terminating end for connection to another electrical element. The forward mating end includes two pair of spring contact arms each having a dimple projecting transversely of the axis for engaging the male terminal. The dimple on one pair of spring contact arms is offset axially of the dimple on the other pair of spring contact arms to reduce the insertion force on the male terminal. Reinforcing ribs extend axially on the spring contact arms. The distances between the reinforcing the ribs and the dimples on the respective spring contact arms are substantially equal whereby the normal force on the male terminal by each dimple is substantially equal.

10 Claims, 2 Drawing Sheets

FEMALE ELECTRICAL TERMINAL WITH IMPROVED CONTACT FORCE

FIELD OF THE INVENTION

This invention generally relates to the art of electrical connectors and, particularly, to a female electrical terminal having an improved, relatively low insertion force.

BACKGROUND OF THE INVENTION

Female electrical terminals are provided in electrical connectors for mating with male electrical terminals, such as sockets for receiving terminal pins. A widely used type of terminal is stamped and formed of sheet metal material in a generally U-shaped cross-section, often used in a multi-contact electrical connector.

With female terminals of the character described above, such as a socket for receiving a terminal pin, a contact force is exerted by the socket on the pin, transversely of the direction of insertion of the pin, to form a stable electrical connection between the socket and the pin. Such female terminals or sockets most often have cantilevered spring contact arms exerting the transverse force on the pin. In order to achieve a very strong or stable electrical connection between the inserted pin and the socket, the spring contact arms exert a relatively high force on the pin. Therefore, the force required to insert the pin into the socket also is relatively high. The greater the spring force, the greater the insertion force of the pin into the socket.

On the other hand, high insertion forces can be undesirable in multi-contact electrical connectors where the number of mating terminals is quite high. Consequently, there constantly is an effort to design the terminals with an acceptable insertion force along with an acceptable contact force. One such design attempt is shown in U.S. Pat. No. 4,687,278 to Grabbe et al, dated Aug. 18, 1987 (which also refers to U.S. Pat. No. 4,550,972). These patents show spring contact beams or arms which have apexes or dimples which engage the inserted male terminal or pin to establish the contact forces on the pin as well as determining the insertion force of the pin into its socket. These patents offset or axially space the apexes or dimples so that they are engaged by the pin sequentially during movement of the pin into the socket. Such offsetting of the apexes or dimples reduces the insertion force on the inserted pin because the pin will not effectively deflect the spring contact beams or arms simultaneously.

A problem with providing spring contact beams or arms with offset or axially spaced pin-engaging apexes or dimples is that the beam length or moment arms of the spring contact arms end up being different and, consequently, different spring contact arms exert different contact forces on the pin. This invention is directed to solving that problem and compensating for the offset or staggered dimple configuration by correspondingly varying the effective beam lengths of the spring contact arms.

SUMMARY OF THE INVENTION

An object, therefore, of the invention is to provide a new and improved female electrical terminal of the character described and which has an improved contact force.

In the exemplary embodiment of the invention, generally, the female electrical terminal for mating with a male electrical terminal includes a forward mating end for receiving the male terminal along a front-to-rear axis and a rear terminating end for connection to another electrical element. The forward mating end includes a pair of spring contact arms each having a dimple projecting transversely of the axis for engaging the male terminal.

Specifically, the invention contemplates that the dimple on one spring contact arm be offset axially of the dimple on the other spring contact arm in order to reduce the insertion force on the male terminal. Reinforcing means are provided on each spring contact arm. The distances between the reinforcing means and the dimple on the respective spring contact arms are substantially equal whereby the normal force on the male terminal by each dimple is substantially equal.

As disclosed herein, the female terminal has a base portion, with the spring contact arms including free ends and opposite ends fixed to the base portion. Therefore, the dimples on the respective spring contact arms are spaced differently from the respective fixed ends of the arms. Therefore, the reinforcing means on the spring contact arm having its dimple spaced further from its fixed end extends further into the arm than the reinforcing means on the spring contact arm having its dimple spaced closer to its fixed end.

In the preferred embodiment of the invention, the female electrical terminal is stamped and formed of sheet metal material, and the reinforcing means are provided by axially extending ribs formed in the terminal. The terminal is generally U-shaped and the base portion includes a base wall and a pair of upstanding side walls which are integral with the spring contact arms. The axially extending ribs span a juncture between the spring contact arms and the side walls. In other words, the ribs extend through the fixed ends of the spring contact arms which are integrally joined to the side walls of the base portion of the terminal. Also in the preferred embodiment, a pair of the spring contact arms, with their offset dimples and offset reinforcing ribs are disposed on each opposite side of the terminal for engaging opposite sides of the male terminal, such as a flat male terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
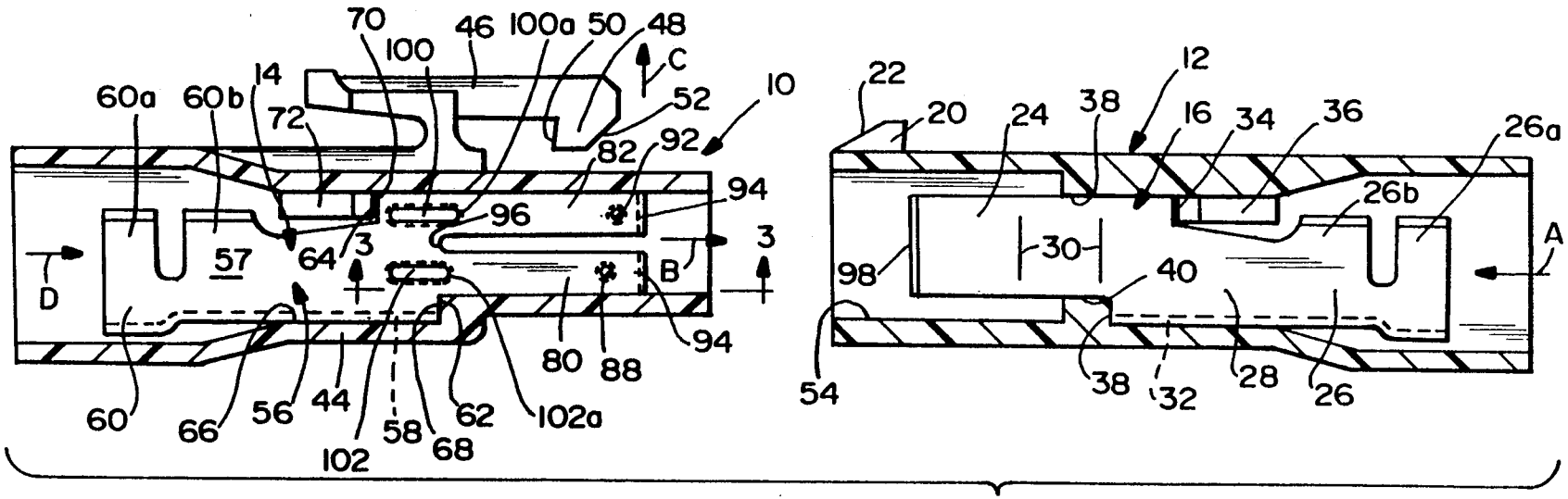
FIG. 1 is an axial section through a pair of mateable electrical connectors in unmated condition, the left-hand connector comprising a plug connector including at least one female terminal incorporating the concepts of the invention.

Referring to the drawings in greater detail, and first to FIG. 1, a first or plug electrical connector, generally designated 10, is shown for insertion into a second or receptacle electrical connector, generally designated 12. Plug connector 10 includes one or more female terminals 14 for mating with one or more male terminals 16 in receptacle connector 12. Although only one female terminal 14 and one male terminal 16 are shown in the drawings, it should be understood that the advantages of the invention are applicable particularly for multi-terminal electrical connectors in order to reduce the insertion force of male terminal 16 into female terminal !4 while maintaining equal contact forces on the male terminal by the spring contact arms of the female terminal, as described hereinafter. Since the invention deals with such forces, and since the advantages are cumulative depending upon the number of terminals used in any given electrical connector assembly, only one female and one male terminal will be described hereinafter.

Receptacle connector 12 includes a dielectric housing 18, such as a housing unitarily molded of plastic or like material. A latch detent 20, having a chamfered detent surface 22 is molded integrally with and projects upwardly from housing 18. Male terminal 16 within receptacle connector housing 18 includes a forward mating end 24, a rear terminating end 26 and an intermediate or base portion 28 therebetween. Forward mating end 24 includes a pair of arms bent inwardly toward each other, as at bend lines 30, so that the forward mating end is a thin, vertically flat male portion of the terminal. Terminating end 26 includes two pairs of crimp arms 26*a* and 26*b* for crimping onto another electrical element, such as an insulated conductor, with crimp arms 26*a* clamping onto the outside of the insulation and crimp arms 26*b* clamping onto an exposed portion of the conductor. Intermediate or base portion 28 of male terminal 16 is generally U-shaped and includes a base wall 32 and a pair of upstanding side walls having notches 34 which snap behind chamfered bosses 36 in side walls of a through passage 38 in housing 18. The male terminal is inserted into housing 18 in the direction of arrow "A", until a bottom notch 38 at the front end of bottom wall 32 abuts against a shoulder 40 at the bottom of through passage 38, whereupon the side walls of the terminal snap behind bosses 36 to lock the terminal within the connector against movement in either of the opposite directions relative to arrow "A".

Plug connector 10 includes a dielectric housing 44 unitarily molded of plastic material or the like and includes an integral latch arm 46 having a hook portion 48 defining a latching surface 50. The front of the hook portion is chamfered, as at 52. Therefore, when plug connector 10 is inserted into an open front end 54 of receptacle connector housing 18, chamfered surface 52 on the front of hook portion 48 of latch arm 46 will engage detent surface 22 on latch detent 20 of receptacle connector 12, biasing latch arm 46 upwardly in the direction of arrow "C", until the hook portion of the latch arm snaps into latching engagement behind latch detent 20.

Except for the female end of female terminal 14, the female terminal has a general configuration quite similar to that of male terminal 16. In other words, the female terminal includes a generally U-shaped intermediate or base portion, generally designated 56, defined by a pair of transversely spaced side walls joined to a base or bottom wall 58. The terminal has a rear terminating end 60 substantially identical to that of the male terminal, i.e. including crimp arms 60*a* and 60*b* for clamping onto the insulation and exposed conductor of an insulated wire. Base portion 56 has a forwardly facing notch 62 and a rearwardly facing notch 64, again as described above in relation to male terminal 16. The female terminal is inserted into a through passage 66 in housing 44 in the direction of arrow "D", until forwardly facing notch 62 abuts against a shoulder 68 at the bottom of through passage 66. At that point, the side walls which define base or intermediate portion 56 snap outwardly whereby shoulders 64 engage behind locking shoulders 70 of chamfered bosses 72 molded integrally with the side walls of the through passage.

Figure 2:
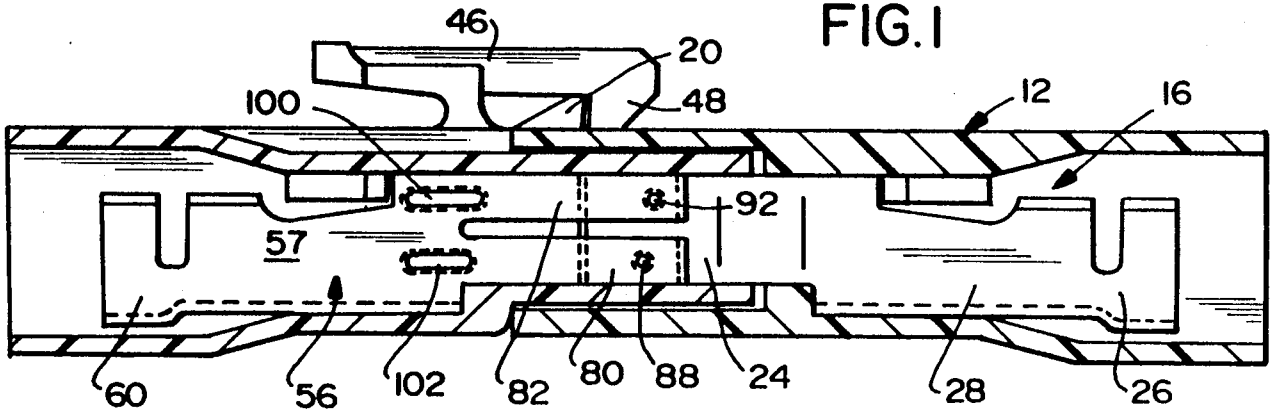
FIG. 2 is a view similar to that of FIG. 1, with the electrical connectors and respective terminals in mated condition.
Figure 3:
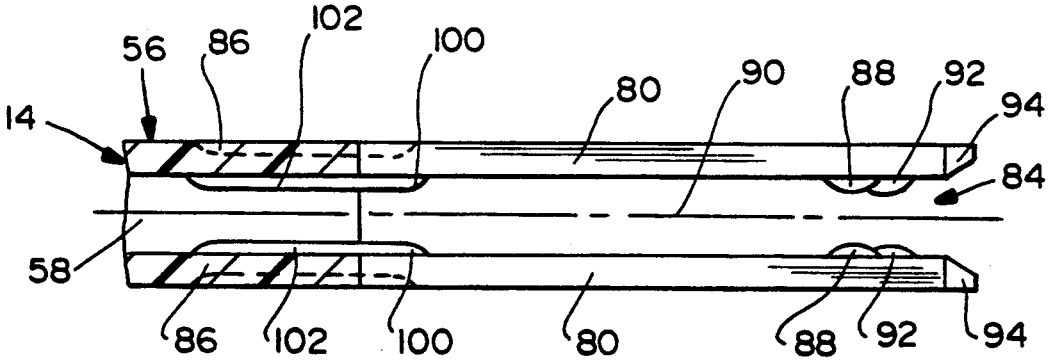
FIG. 3 is a fragmented section taken generally along line 3—3 of FIG. 1.

In order to reduce the insertion force of male terminal 16 (i.e. flat male mating end 24) into female terminal 14, and referring to FIG. 3 in conjunction with FIGS. 1 and 2, the mating end of the female terminal is defined by a pair of spring contact arms 80 and 82 on each opposite side of the female terminal. It can be seen in FIG. 1 that each pair of spring contact arms 80 and 82 on each side of the terminal are vertically spaced. It can be seen in FIG. 3 that the two pairs of spring contact arms on the two sides of the terminal are laterally or transversely spaced to define a gap, generally designated 84, therebetween for receiving flat male mating end 24 of male terminal 16. It can be seen in both FIGS. 1 and 3 that all of the spring contact arms are formed integrally with and project forwardly of side walls 86 of base portion 56, the side walls being integral with and projecting upwardly from base wall 58.

Referring to only one pair of spring arms 80 and 82 on one side of female terminal 14, spring contact arm 80 has a dimple 88 projecting transversely of the terminal and inwardly toward a front-to-rear axis 90 (FIG. 3) of the terminal. Spring arm 82 has a dimple 92 which also projects inwardly therefrom. It can be seen in FIG. 1 that dimples 88 and 92 on spring contact arms 80 and 82, respectively, are offset axially of the terminal. In other words, dimple 88 on spring contact arm 80 is closer to base portion 56 of the terminal than is dimple 92 on spring contact arm 82.

At this point, it can be understood that each spring arm has a free end 94 and an opposite end, as at 96, fixed to base portion 56. Specifically, all of the spring contact arms are joined integrally with side walls 86 of base portion 56 of the terminal. Therefore, even though the more sturdy side walls 86 of the base portion can flex laterally to some degree in order to snap behind latch bosses 72 within housing passage 66, the spring contact arms themselves can flex laterally relative to the more sturdy or rigid side walls of the terminal base portion.

As stated above, by offsetting dimples 88 and 92 axially of female terminal 14, the insertion force of male terminal 16 into the female terminal is reduced. In other words, the flat mating end 24 of the male terminal, when inserted into gap 84 (FIG. 3), will engage dimples 92 sequentially before engaging dimples 88. With flat mating end 24 being provided with a chamfered distal end 98 (FIG. 1), the male mating end will spread two of the four spring arms by first engaging dimples 92 on spring arms 82 and then the flat mating end will spread the other two spring arms by engaging dimples 88 on spring arms 80, thereby reducing the insertion force of the male terminal into the female terminal.

With dimples 88 and 92 being axially offset relative to each other, the invention contemplates means for compensating for this differential spacing in order to maintain an equal or constant contacting force between each individual spring contact arm and the flat mating end 24 of male terminal 16. More particularly, reinforcing means in the form of reinforcing ribs 100 and 102 are formed integrally in side walls 86 of base portion 26 of the female terminal, and the reinforcing ribs extend into the spring contact arms, i.e. axially beyond their fixed ends 96. Reinforcing ribs 100 extend into spring contact arms 82 and reinforcing ribs 102 extend into spring contact arms 80. It can be seen that reinforcing rib 100 is longer than reinforcing rib 102. More importantly, a forward end 100*a* of reinforcing rib 100 is disposed further into spring arm 82 than a forward end 102*a* of reinforcing rib 102 extending into spring contact arm 80. By configuring the reinforcing ribs as described above, particularly in differentially locating the forward ends 100*a* and 102*a* of the reinforcing ribs, spring contact arms 82 are "stiffened" more than are spring contact arms 80. The reason for this differential stiffening is to compensate for the offsetting of dimples 92 and 88.

Specifically, the invention contemplates that the distance between dimple 88 and forward end 102*a* of reinforcing rib 102, lengthwise of spring contact arm 80, be substantially equal to the distance between dimple 92 and forward end 100*a* of reinforcing rib 100 on spring contact arm 82. Therefore, the "beam lengths" or moment arms of all of the spring contact arms are substantially equal. The result is that each dimple 88, 92 exerts a substantially equal normal force on flat male mating end 24 of male terminal 16.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a female electrical terminal for mating with a male electrical terminal, including a forward mating end for receiving the male terminal along a front-to-rear axis and a rear terminating end for connection to another electrical element, the forward mating end including two pair of opposing spring contact arms each extending from the rear terminating end and having a dimple projecting transversely of the axis for engaging the male terminal, wherein the improvement comprises the dimple on one opposing pair of spring contact arms being offset axially of the dimple on the other pair of spring contact arms to reduce the resultant insertion force on the male terminal, reinforcing means on each spring contact arm, and the distances between the reinforcing means and the dimples on the respective spring contact arms being substantially equal whereby the normal force on the male terminal by each dimple is substantially equal.

2. In a female electrical terminal as set forth in claim 1, wherein one of said pair of spring contact arms is disposed on each opposite side of the terminal for engaging opposite sides of a flat male terminal.

3. In a female electrical terminal as set forth in claim 1, wherein said reinforcing means comprise axially extending ribs formed in the terminal.

4. In a female electrical terminal as set forth in claim 3, wherein the terminal includes a generally U-shaped intermediate portion including a base wall and a pair of upstanding side walls integral with the spring contact arms, and said axially extending ribs span a juncture between the spring contact arms and the side walls.

5. In a female electrical terminal for mating with a male electrical terminal, including a forward mating end projecting from a base portion for receiving the male terminal along a front-to-rear axis and a rear terminating end for connection to another electrical element, the forward mating end including two pair of opposing spring contact arms having free ends and opposite ends fixed to the base portion, the spring contact arms each having a dimple projecting transversely of the axis for engaging the male terminal, wherein the improvement comprises the dimple on one pair of spring contact arms being offset axially of the dimple on the other pair of spring contact arms to reduce the insertion force on the male terminal, reinforcing means on the base portion and extending axially into each spring contact arm, and the reinforcing means on the spring contact arms having their dimple spaced further from their fixed end extending further into the arms than the reinforcing means on the spring contact arms having their dimple spaced closer to their fixed end.

6. In a female electrical terminal as set forth in claim 5, wherein one of said pair of spring contact arms is disposed on each opposite side of the terminal for engaging opposite sides of a flat male terminal.

7. In a female electrical terminal as set forth in claim 5, wherein said reinforcing means comprise axially extending ribs formed in the terminal.

8. In a female electrical terminal as set forth in claim 7, wherein the base portion of the female terminal is generally U-shaped and including a base wall and a pair of upstanding side walls integral with the spring contact arms, and said axially extending ribs span a juncture between the spring contact arms and the side walls.

9. In a female electrical terminal as set forth in claim 8, wherein said female electrical terminal is fabricated of stamped and formed sheet metal material.

10. In a female electrical terminal for mating with a male electrical terminal, including a forward mating end for receiving the male terminal along a front-to-rear axis and a rear terminating end for connection to another electrical element, the forward mating end including two pair of opposing spring contact arms each having a dimple projecting transversely of the axis for engaging the male terminal, wherein the improvement comprises the dimple on one pair of spring contact arms being offset axially of the dimple on the other spring contact arms to reduce the insertion force on the male terminal, and means for stiffening the spring contact arms in proportion to the axially offsetting of the dimples on the respective spring contact arms so that the normal force on the male terminal by each dimple is substantially equal.

* * * * *